US011898781B2

(12) United States Patent
Uemura et al.

(10) Patent No.: US 11,898,781 B2
(45) Date of Patent: Feb. 13, 2024

(54) GAS HEADER, HEAT EXCHANGER, AND REFRIGERATION CYCLE APPARATUS

(71) Applicant: Mitsubishi Electric Corporation, Tokyo (JP)

(72) Inventors: Takamasa Uemura, Tokyo (JP); Faming Sun, Tokyo (JP); Yoji Onaka, Tokyo (JP); Yohei Kato, Tokyo (JP); Norihiro Yoneda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 382 days.

(21) Appl. No.: 17/426,635

(22) PCT Filed: Mar. 5, 2019

(86) PCT No.: PCT/JP2019/008507
§ 371 (c)(1),
(2) Date: Jul. 29, 2021

(87) PCT Pub. No.: WO2020/178966
PCT Pub. Date: Sep. 10, 2020

(65) Prior Publication Data

US 2022/0099344 A1 Mar. 31, 2022

(51) Int. Cl.
*F25B 39/04* (2006.01)
*F28D 1/053* (2006.01)
(Continued)

(52) U.S. Cl.
CPC ..... *F25B 39/04* (2013.01); *F28D 1/053* (2013.01); *F28F 1/02* (2013.01); *F28F 9/02* (2013.01)

(58) Field of Classification Search
CPC ..... F25B 39/04; F25B 39/00; F28D 1/053; F28D 2021/0068; F28D 1/05316;
(Continued)

(56) References Cited

U.S. PATENT DOCUMENTS 5,203,407 A 4/1993 Nagasaka
9,518,788 B2 * 12/2016 Jindou ..... F28F 1/04
(Continued)

FOREIGN PATENT DOCUMENTS

JP 3-67869 U 7/1991
JP 4-174297 A 6/1992
(Continued)

OTHER PUBLICATIONS

Extended European Search Report dated Feb. 15, 2022 in European Application No. 19918290.8.
(Continued)

*Primary Examiner* — Ana M Vazquez
(74) *Attorney, Agent, or Firm* — XSENSUS LLP

(57) ABSTRACT

A gas header includes a first tubular portion and a second tubular portion that are integrated with each other. The second tubular portion is provided across the first tubular portion from a plurality of flat pipes in the horizontal direction. The second tubular portion is connected at a position midway in an up-down direction and upper than a center of the second tubular portion in the up-down direction to a refrigerant pipe. A wall between the first tubular portion and the second tubular portion has a first hole opening and extending in the horizontal direction at a portion connected to the refrigerant pipe and a second hole through which the first tubular portion and the second tubular portion communicate with each other at a portion lower than the first hole and having a hole diameter smaller than a hole diameter of the first hole.

12 Claims, 11 Drawing Sheets

(51) Int. Cl.
*F28F 1/02* (2006.01)
*F28F 9/02* (2006.01)

(58) Field of Classification Search
CPC ..... F28F 1/02; F28F 9/02; F28F 2009/224; F28F 9/0214; F28F 9/0243; F28F 9/0265
See application file for complete search history.

(56) References Cited

U.S. PATENT DOCUMENTS

| | | | | |
|---|---|---|---|---|
| 2008/0078541 | A1* | 4/2008 | Beamer ..... | F28F 9/0273 29/890.052 |
| 2020/0300515 | A1 | 9/2020 | Sun et al. | |

FOREIGN PATENT DOCUMENTS

| | | | |
|---|---|---|---|
| JP | 2009-92359 | A | 4/2009 |
| JP | 2015-21664 | A | 2/2015 |
| WO | 2018/225252 | A1 | 12/2018 |

OTHER PUBLICATIONS

International Search Report and Written Opinion dated Apr. 2, 2019, received for PCT Application PCT/JP2019/008507, Filed on Mar. 5, 2019, 10 pages including English Translation.

* cited by examiner

GAS HEADER, HEAT EXCHANGER, AND REFRIGERATION CYCLE APPARATUS

CROSS-REFERENCE TO RELATED APPLICATION

The present application is based on PCT filing PCT/JP2019/008507, filed Mar. 5, 2019, the entire contents of which are incorporated herein by reference.

TECHNICAL FIELD

The present disclosure relates to a gas header connected to a plurality of flat pipes at one end portion of each of the plurality of flat pipes and connected to a refrigerant pipe, a heat exchanger, and a refrigeration cycle apparatus.

BACKGROUND ART

In an evaporator of an existing air-conditioning apparatus, gas-liquid two-phase state refrigerant in which gas refrigerant and liquid refrigerant are mixed is caused to flow and distributed by a refrigerant distributor into a plurality of heat transfer pipes. The refrigerant distributed into the plurality of heat transfer pipes then removes heat from air and enters a gas-rich state or a gas-single-phase state. Subsequently, the refrigerant flows into a gas header to be merged together and flows out from a refrigerant pipe to the outside of the evaporator.

Here, in the gas header, the refrigerant moves upward from below. Therefore, compressor oil accumulates at the bottom portion of the gas header. When a state in which compressor oil has accumulated at the bottom portion of the gas header is maintained, the amount of oil in the compressor decreases and may cause malfunction of the compressor. It is thus necessary to reduce the amount of the compressor oil that accumulates at the bottom portion of the gas header. Here, there is a technology in which the gas header is provided with a bypass flow passage to improve oil-returning performance in returning the compressor oil in the inner portion of the gas header (refer to, for example, Patent Literature 1).

Meanwhile, to respond to a recent demand for improvement in energy consumption performance and reduction in the amount of refrigerant, a reduction in the diameter of a heat transfer pipe and an increase in the number of paths of the heat transfer pipe used in a heat exchanger have been underway. With such a situation, a flat pipe having narrow flow passages is commonly used, instead of a circular pipe, which has been used, as a heat transfer pipe. In addition, there is a technology in which an end portion of a flat pipe is inserted into the inner portion of a header (refer to, for example, Patent Literature 2).

CITATION LIST

Patent Literature

Patent Literature 1: Japanese Unexamined Utility Model Registration Application Publication No. 3-067869

Patent Literature 2: Japanese Unexamined Patent Application Publication No. 2015-021664

SUMMARY OF INVENTION

Technical Problem

The technology in Patent Literature 1 prevents accumulation of the compressor oil by providing the gas header with the bypass flow passage. Provision of the bypass flow passage in the header, however, causes a problem of increasing a pressure loss of refrigerant in the gas header. Provision of the bypass flow passage also causes a problem of increasing manufacturing costs. Even when, as with the technology in Patent Literature 2, the tip of a flat pipe is inserted into a gas header, there is a problem of increasing a pressure loss of refrigerant in the gas header.

The present disclosure is intended to solve the aforementioned problems, and an object of the present disclosure is to provide a gas header capable of reducing a pressure loss of refrigerant while achieving a simple structure, a heat exchanger, and a refrigeration cycle apparatus.

Solution to Problem

A gas header according to an embodiment of the present disclosure is a gas header connected to a plurality of flat pipes at one end portion of each of the plurality of flat pipes. The plurality of flat pipes are spaced from each other and arranged in an up-down direction. The gas header is connected to a refrigerant pipe. Refrigerant flows out through the refrigerant pipe when refrigerant flows in through the plurality of flat pipes, and refrigerant flows out through the plurality of flat pipes when refrigerant flows in through the refrigerant pipe. The gas header includes a first tubular portion including a flow passage for refrigerant extending in the up-down direction and a second tubular portion including a flow passage having a sectional area smaller than a sectional area of the flow passage of the first tubular portion. The first tubular portion and the second tubular portion are integrated with each other. The one end portion of each of the plurality of flat pipes is inserted midway from one direction along a horizontal direction into an inner portion of the first tubular portion. The second tubular portion is provided across the first tubular portion from the plurality of flat pipes in the horizontal direction. The second tubular portion is connected at a position midway in the up-down direction and upper than a center of the second tubular portion in the up-down direction to the refrigerant pipe. A wall between the first tubular portion and the second tubular portion has a first hole opening and extending in the horizontal direction at a portion connected to the refrigerant pipe and a second hole through which the first tubular portion and the second tubular portion communicate with each other at a portion lower than the first hole and having a hole diameter smaller than a hole diameter of the first hole.

A heat exchanger according to another embodiment of the present disclosure includes the aforementioned gas header.

A refrigeration cycle apparatus according to still another embodiment of the present disclosure includes the aforementioned heat exchanger.

Advantageous Effects of Invention

In the gas header, the heat exchanger, and the refrigeration cycle apparatus according to embodiments of the present disclosure, a first tubular portion and a second tubular portion communicate with each other through a first hole and a second hole provided in a wall surface. Consequently, it is possible to reduce a pressure loss of refrigerant while achieving a simple structure.

DESCRIPTION OF EMBODIMENTS

Figure 1:
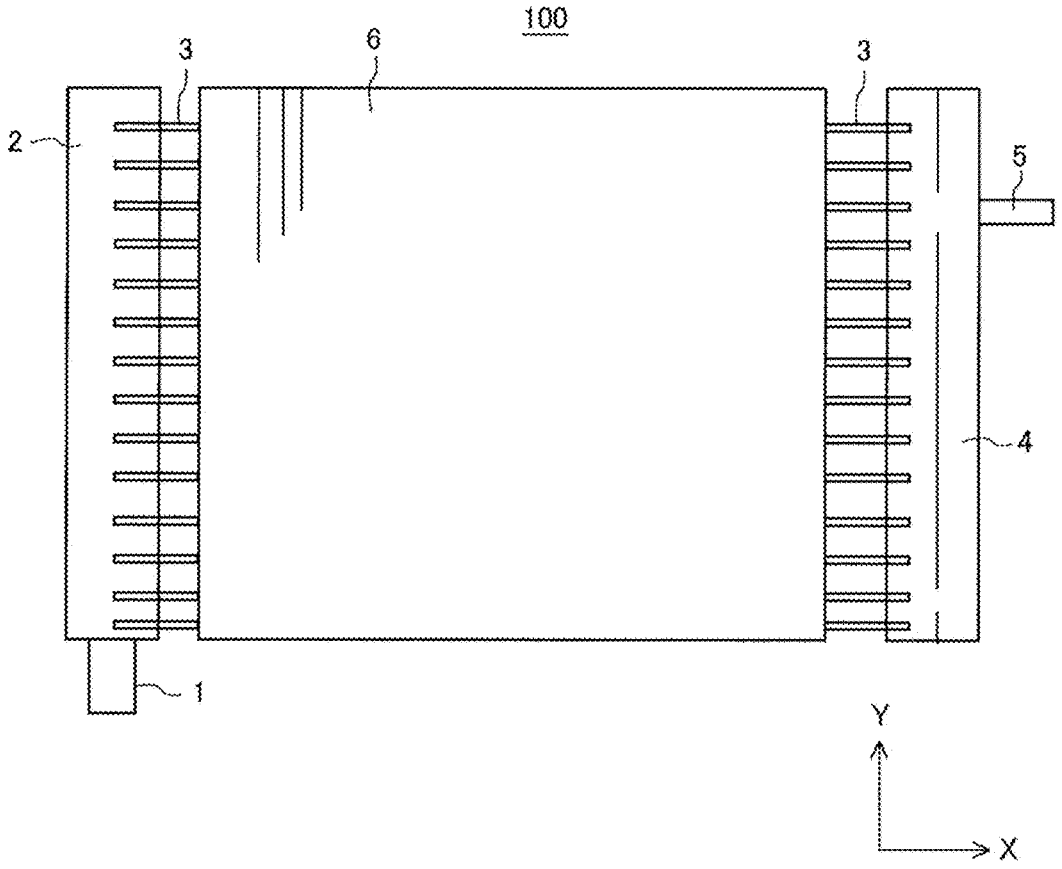
FIG. 1 is a schematic view of a heat exchanger according to Embodiment 1 of the present disclosure.

Embodiments of the present disclosure will be described below with reference to the drawings. In the drawings, components with identical signs are identical or correspond to each other, which is common in the whole text of the specification. In the drawings of sectional views, hatching is omitted, as appropriate, in consideration of visibility. In addition, forms of components described in the whole text of the specification are merely presented as examples and are not limited to those in the description.

Embodiment 1

<Configuration of Heat Exchanger>

FIG. 1 is a schematic view of a heat exchanger 100 according to Embodiment 1 of the present disclosure. Here, the X direction in the drawings indicates the horizontal direction. The Y direction indicates the up-down direction or the vertical direction orthogonal to the X direction.

As illustrated in FIG. 1, the heat exchanger 100 includes a gas header 4, a plurality of flat pipes 3, fins 6, a refrigerant distributor 2, an inflow pipe 1, and an outflow pipe 5.

The plurality of flat pipes 3 are arranged such that the plurality of flat pipes 3 extend in the X direction and are spaced from each other in the Y direction. Because of the flat pipes 3 thus used as heat transfer pipes, the heat exchanger 100 is also called a flat-pipe heat exchanger.

The gas header 4 longitudinally extends in the Y direction and through which refrigerant flows in the Y direction. The gas header 4 is connected to one end portion of each of the plurality of flat pipes 3 spaced from each other and arranged in the Y direction. The gas header 4 is connected to the outflow pipe 5 that is a refrigerant pipe through which refrigerant flows out when refrigerant flows in through the plurality of flat pipes 3 and through which refrigerant flows in when refrigerant flows out through the plurality of flat pipes 3.

Regarding the refrigerant distributor 2, the refrigerant distributor 2 that is connected to the other end portion of each of the plurality of flat pipes 3, which is not the one end portion connected to the gas header 4, is also called a liquid header. The type of the refrigerant distributor 2 is not particularly limited.

A plurality of fins 6 are provided to the plurality of flat pipes 3 and are spaced from each other in the X direction. The fins 6 extend in the Y direction similarly to the gas header 4 or the refrigerant distributor 2. The fins 6 are joined to the outer pipe surface of each of the plurality of flat pipes 3. The fins 6 are, for example, plate fins or corrugated fins. The type of the fins 6 is not limited.

At least one outflow pipe 5 is connected to an end portion of the gas header 4. The outflow pipe 5 connects the heat exchanger 100 to other components and refrigerant flows through the outflow pipe 5 in a refrigeration cycle apparatus described later. The sectional shape of the flow passage of the outflow pipe 5 is not limited to a circular shape.

At least one inflow pipe 1 is connected to an end portion of the refrigerant distributor 2.

<Operation of Heat Exchanger 100 as Evaporator>

Liquid-phase or gas-liquid two-phase state refrigerant flows into the refrigerant distributor 2 via the inflow pipe 1. The refrigerant that has flowed into the refrigerant distributor 2 is sequentially distributed to the flat pipes 3 in order from the flat pipe 3 closer to the inflow pipe 1. Consequently, the refrigerant is distributed from the refrigerant distributor 2 to the plurality of flat pipes 3. The gas-liquid two-phase state refrigerant distributed to each of the flat pipes 3 exchanges heat with ambient air through the fins 6, becomes gas-rich or gas-state refrigerant, and flows into the gas header 4. The refrigerant flows into the gas header 4 from the plurality of flat pipes 3 and is merged together. The merged refrigerant passes through the outflow pipe 5 and flows out from the heat exchanger 100.

<Configuration of Gas Header>

Figure 2:
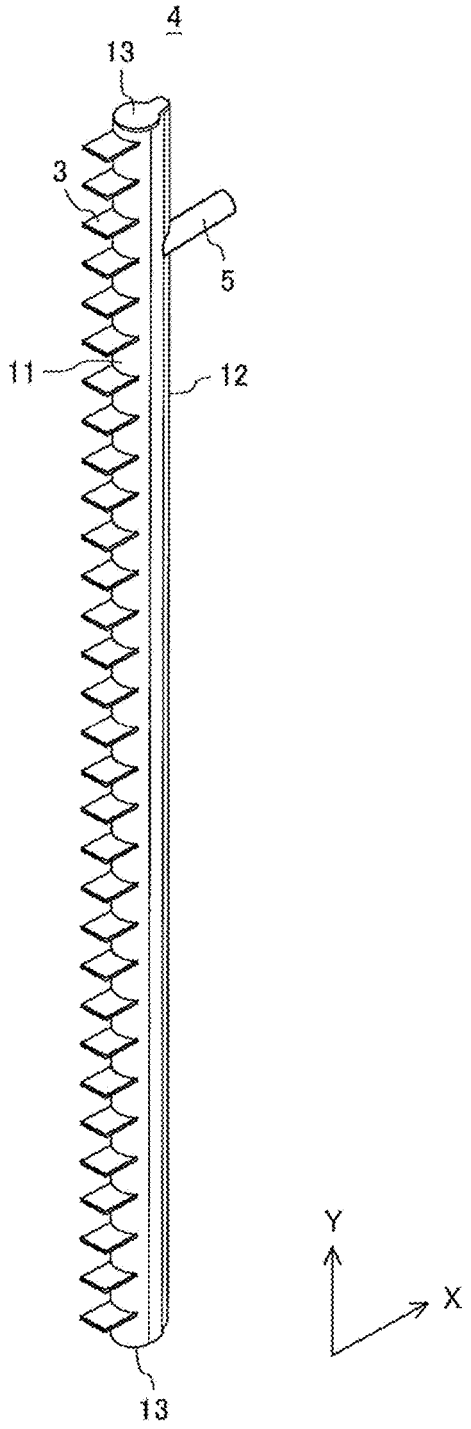
FIG. 2 is a perspective view of a gas header according to Embodiment 1 of the present disclosure.
Figure 3:
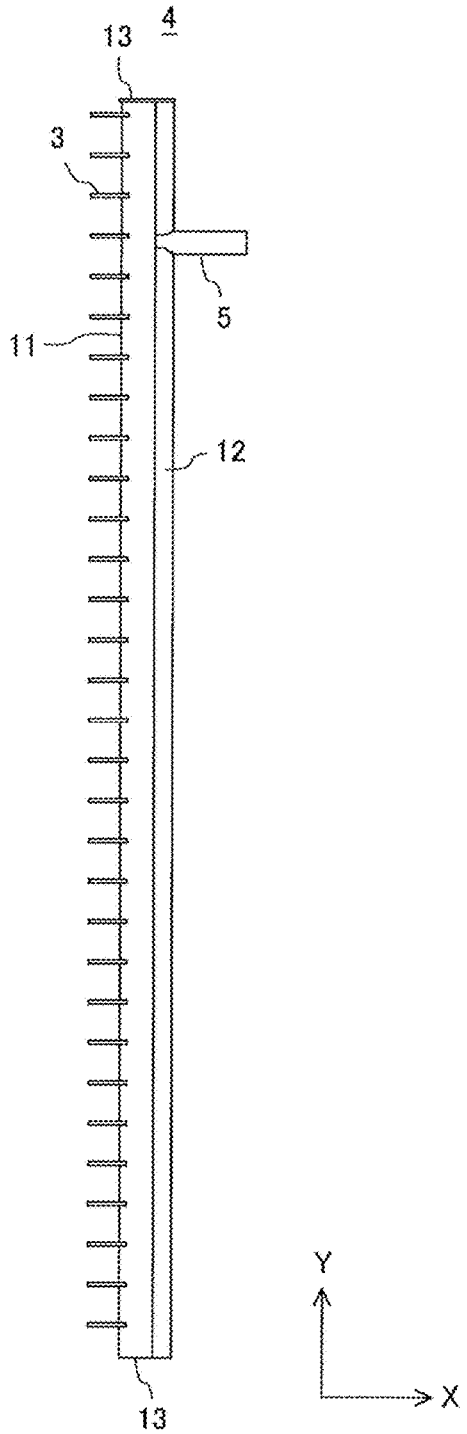
FIG. 3 is a front view of the gas header according to Embodiment 1 of the present disclosure.
Figure 4:
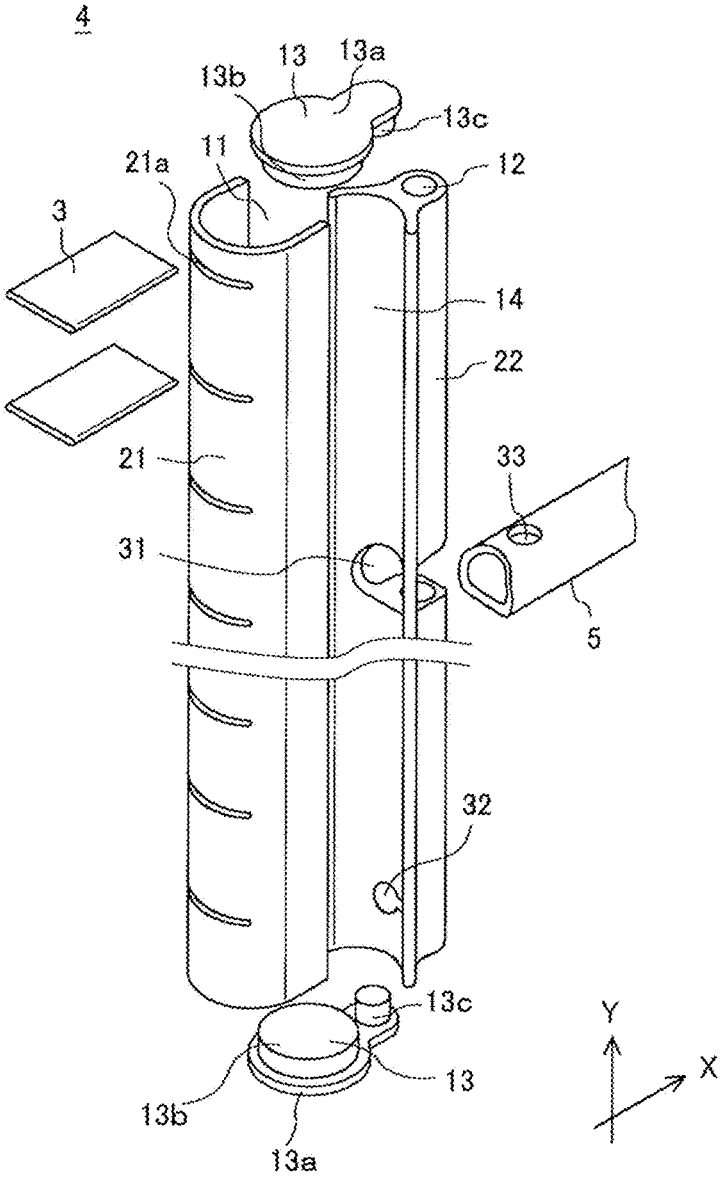
FIG. 4 is an exploded perspective view of the gas header according to Embodiment 1 of the present disclosure.

FIG. 2 is a perspective view of the gas header 4 according to Embodiment 1 of the present disclosure. FIG. 3 is a front view of the gas header 4 according to Embodiment 1 of the present disclosure. FIG. 4 is an exploded perspective view of the gas header 4 according to Embodiment 1 of the present disclosure. In FIG. 4, an upper portion and a lower portion of the gas header 4 are illustrated with an intermediate portion in the Y direction omitted.

As illustrated in FIG. 2, FIG. 3, and FIG. 4, the gas header 4 is connected to the one end portion of each of the plurality of flat pipes 3 spaced from each other and arranged in the Y direction, and the gas header 4 is connected to the outflow pipe 5 through which refrigerant flows out when refrigerant flows in through the plurality of flat pipes 3 and through which refrigerant flows in when refrigerant flows out through the plurality of flat pipes 3.

The gas header 4 includes a first tubular portion 11 and a second tubular portion 12 that are integrated with each other.

The first tubular portion 11 is elongated in the Y direction and through which the refrigerant flows in the Y direction. The one end portion of each of the plurality of flat pipes 3 is inserted midway from one direction along the horizontal direction into the inner portion of the first tubular portion 11.

The second tubular portion 12 is provided across the first tubular portion 11 from the plurality of flat pipes 3 in the X direction. The second tubular portion 12 is elongated in the Y direction and through which the refrigerant flows in the Y direction. The second tubular portion 12 has a flow passage having a sectional area smaller than the sectional area of the flow passage of the first tubular portion 11. The second tubular portion 12 is connected at a position midway in the Y direction and upper than the center of the second tubular portion 12 in the Y direction to the outflow pipe 5.

The first tubular portion 11 and the second tubular portion 12 are equal in length to each other in the Y direction. The X-direction heights of both end portions in the Y direction of the first tubular portion 11 and the second tubular portion 12 coincide with each other.

As illustrated in FIG. 4, a wall 14 between the first tubular portion 11 and the second tubular portion 12 has a first hole 31 and a second hole 32.

The first hole 31 opens in the wall 14 at a portion of the second tubular portion 12 connected to the outflow pipe 5 and extends in the X direction.

The second hole 32 is a hole through which the first tubular portion 11 and the second tubular portion 12 communicate with each other at a portion of the wall 14 lower than the first hole 31. That is, the second hole 32 provided in the wall 14 is a hole through which the first tubular portion 11 and the second tubular portion 12 communicate with each other at a position lower than the first hole 31, which communicates with the outflow pipe 5. The shape of each of the first hole 31 and the second hole 32 is not limited to a circular shape.

The hole diameter of the second hole 32 is smaller than the hole diameter of the first hole 31. The flow velocity of the refrigerant that passes through the second hole 32 is thus increased. Therefore, the air flow of the gas refrigerant that flows into the first tubular portion 11 easily causes the oil that accumulates at the bottom portion of the first tubular portion 11 to pass through the second hole 32 to be guided into the second tubular portion 12 and return to a compressor 51, which will be described later, via the outflow pipe 5.

The sectional shape of the flow passage in the inner portion of each of the first tubular portion 11 and the second tubular portion 12 as viewed in a cross-section in the X direction is circular. The sectional shape of the flow passage is not limited to a circular shape.

As illustrated in FIG. 1, FIG. 2, FIG. 3, and FIG. 4, an end portion of at least one flat pipe 3 of the plurality of flat pipes 3 inserted into the first tubular portion 11 is positioned at a position lower than the second hole 32 in the gas header 4.

As illustrated in FIG. 2, FIG. 3, and FIG. 4, the gas header 4 includes a pair of header covers 13 that cover the inner portions of both of the first tubular portion 11 and the second tubular portion 12 at both ends of each of the first tubular portion 11 and the second tubular portion 12 in the longitudinal direction.

As illustrated in FIG. 4, the pair of header covers 13 each include a large-diameter portion 13*a* abutting on end surfaces of both of the first tubular portion 11 and the second tubular portion 12. The pair of header covers 13 each include a first cap portion 13*b* projecting from the large-diameter portion 13*a* into the inner portion of the first tubular portion 11 to cap the inner portion of the first tubular portion 11. The pair of header covers 13 each include a second cap portion 13*c* projecting from the large-diameter portion 13*a* into the inner portion of the second tubular portion 12 to cap the inner portion of the second tubular portion 12.

The gas header 4 includes a first part 21 forming a portion of the first tubular portion 11 and having a plurality of holes 21*a* into which the plurality of flat pipes 3 are inserted and fixed. The first part 21 has, for example, a semicircular tube shape formed by removing a portion of a circular tube shape.

The plurality of holes 21*a* are arranged at prescribed intervals in the X direction. For example, the flat pipes 3 are inserted in the X direction into the holes 21*a* to be substantially perpendicular to a side surface portion of the first part 21. Edge portions of the holes 21*a* and the outer peripheral surfaces of the flat pipes 3 are joined to each other by brazing. The brazing method for joining the edge portions of the holes 21*a* and the outer peripheral surfaces of the flat pipes 3 is not particularly limited. Burring may be performed on the edge portions of the holes 21*a* for ease of brazing between the edge portions of the holes 21*a* and the outer peripheral surfaces of the flat pipes 3.

The gas header 4 includes a second part 22 forming the second tubular portion 12 and the remaining portion of the first tubular portion 11 that is other than the portion of the first tubular portion 11 that is formed by the first part 21. The first part 21 and the second part 22 form the first tubular portion 11 by being fitted to each other.

The outflow pipe 5 is inserted into the outer wall of the second tubular portion 12 and joined to the first hole 31 opening in the wall 14. A joined end portion of the outflow pipe 5 joined to the wall 14 is open. That is, at a position higher than the center position of the gas header 4 in the Y direction, the outflow pipe 5 is joined to the first hole 31 provided in the wall 14 and communicates with the first tubular portion 11. The first hole 31 is a hole that opens and extends toward the center axis of the joined end portion of the outflow pipe 5.

The outflow pipe 5 has a pair of holes 33 at an upper and lower portions in the Y direction in the vicinity of the joined end portion. The pair of holes 33 are continuous with the flow passage of the second tubular portion 12. Consequently, gas-state refrigerant that flows out from the flat pipes 3 at an upper portion in the Y direction, passes through the first tubular portion 11, and flows in through the first hole 31 at which the tip of the outflow pipe 5 is present and gas-state refrigerant that flows out from the flat pipes 3 close to a lower portion in the Y direction, passes through the second tubular portion 12, and flows in through the hole 33 in the lower surface of the outflow pipe 5 are merged together in the outflow pipe 5.

Here, the apparent sectional area of the flow passage of the first tubular portion 11 is decreased by the insertion of the flat pipes 3. Consequently, gas-state refrigerant that flows out from, in particular, the flat pipes 3 close to the lower portion of the first tubular portion 11 passes through the second hole 32 and flows into the outflow pipe 5 through the hole 33 via the second tubular portion 12, rather than via the first tubular portion 11.

The first part 21, the second part 22, and the pair of header covers 13 are, for example, all made of aluminum and joined to each other by brazing. The outflow pipe 5 is joined to the second part 22 by brazing.

<Operation of Gas Header 4 with Heat Exchanger 100 as Evaporator>

Figure 5:
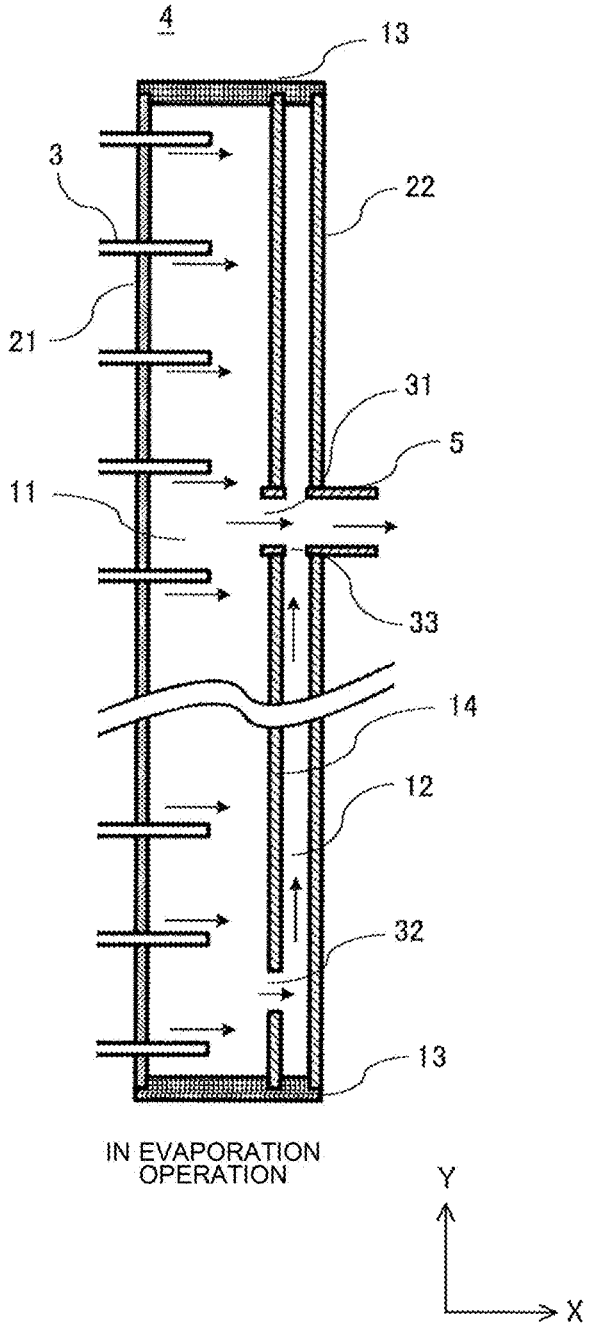
FIG. 5 is an explanatory view in which the gas header when the heat exchanger according to Embodiment 1 of the present disclosure is used as an evaporator is illustrated in a vertical section.
Figure 6:
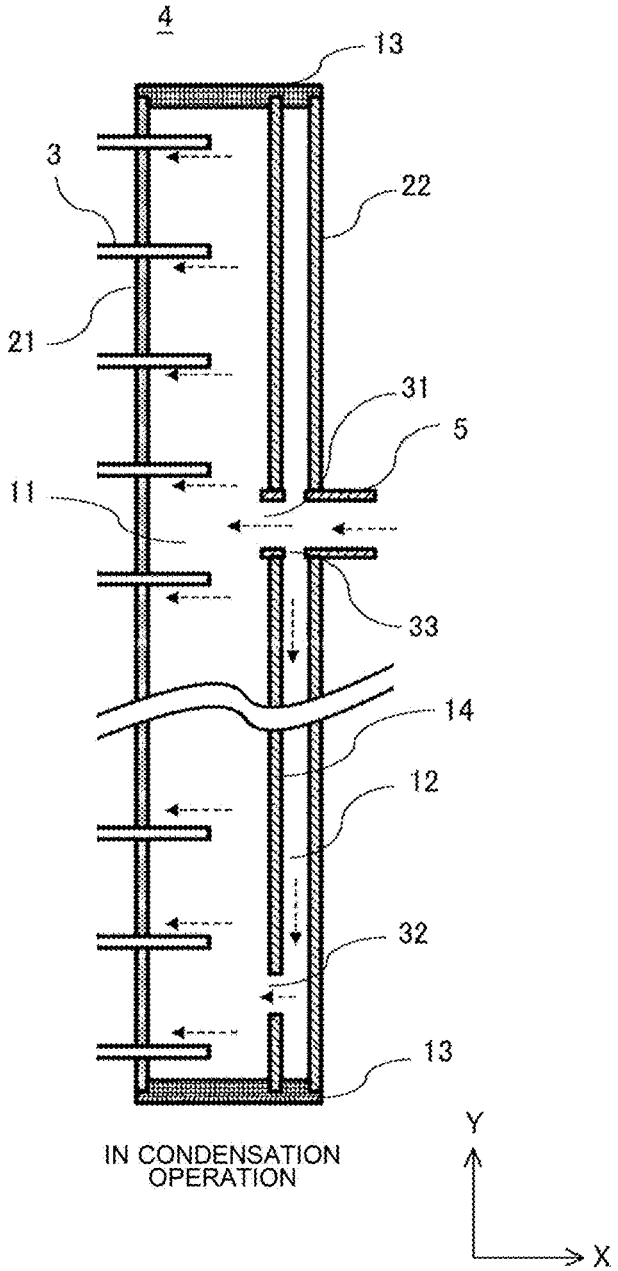
FIG. 6 is an explanatory view in which the gas header when the heat exchanger according to Embodiment 1 of the present disclosure is used as a condenser is illustrated in a vertical section.

FIG. 5 is an explanatory view in which the gas header 4 when the heat exchanger 100 according to Embodiment 1 of the present disclosure is used as an evaporator is illustrated in a vertical section. FIG. 6 is an explanatory view in which the gas header 4 when the heat exchanger 100 according to Embodiment 1 of the present disclosure is used as a condenser is illustrated in a vertical section. An operation of the gas header 4 when the heat exchanger 100 is used as a condenser is illustrated in FIG. 6 in contrast to an operation of the gas header 4 when the heat exchanger 100 is used as an evaporator illustrated in FIG. 5.

The solid-line arrows illustrated in FIG. 5 indicate flow directions of refrigerant when the heat exchanger 100 is used as an evaporator. Portion of the gas-state refrigerant that has flowed into the first tubular portion 11 flows into the outflow pipe 5 directly. The other portion of the gas-state refrigerant that has flowed into the first tubular portion 11 passes through the second tubular portion 12 and flows into the outflow pipe 5.

<Existing Problems>

In the inner portion of the first tubular portion 11, the tip of each of the flat pipes 3 is inserted to an intermediate portion in the X direction. Therefore, the gas-state refrigerant that flows in the first tubular portion 11 in the Y direction alternately passes through a flow passage expanded portion, which is a space into which the flat pipe 3 is not inserted, and a flow passage reduced portion, which is a gap narrowed by the insertion of the flat pipe 3. Expansion and reduction of the flow of the gas-state refrigerant that flows in the first tubular portion 11 are generated sequentially. Consequently, a pressure loss in the pipe of the gas header 4 is generated. Furthermore, refrigerating machine oil mixed in the gas-state refrigerant is separated and drops to a lower portion of the first tubular portion 11. Thus, the refrigerating machine oil easily accumulates at the lower portion of the first tubular portion 11. When the amount of refrigerating machine oil that returns to the compressor 51 is decreased, the performance and the reliability of the compressor 51 are decreased because of, for example, sliding failure of a compression mechanism portion of the compressor 51.

To solve the aforementioned problem, there is a technology in which a bypass flow passage is provided at the lower portion of the gas header 4 to reduce a pressure loss of refrigerant and improve returning of refrigerating machine oil. However, provision of the bypass flow passage increases the size of the gas header 4. A size increase of the gas header 4 has a problem of decreasing the installation area of the heat exchanger 100 by the amount of the size increase. Provision of the bypass flow passage also has a problem of increasing manufacturing costs.

<Solutions to Problems>

In the gas header 4 of the heat exchanger 100, however, the first tubular portion 11 and the second tubular portion 12 communicate with each other through the second hole 32 provided in the wall 14. In this configuration, it is possible to reduce the size of the gas header 4 while reducing a pressure loss of refrigerant and improving returning of refrigerating machine oil.

In addition, it is possible to join end portions of the wall 14 and the header covers 13 to each other by brazing to improve the strength and airtightness of the gas header 4.

<Configuration of Lower Portion of Gas Header 4>

Figure 7:
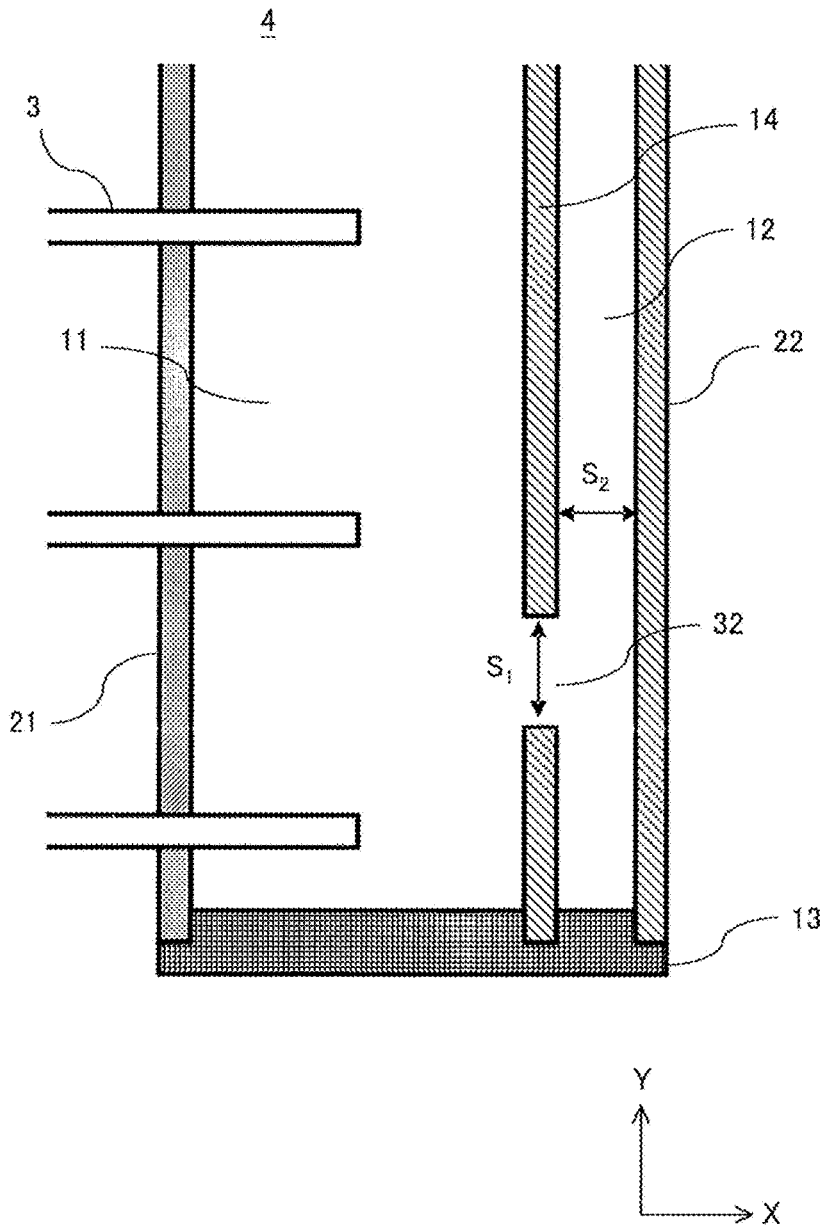
FIG. 7 is an explanatory view in which a lower portion of the gas header according to Embodiment 1 of the present disclosure is enlarged and illustrated in a vertical section.

FIG. 7 is an explanatory view in which a lower portion of the gas header 4 according to Embodiment 1 of the present disclosure is enlarged and illustrated in a vertical section. As illustrated in FIG. 7, a sectional area $S_1$ of the opening of the second hole 32 is more than or equal to a sectional area $S_2$ of the flow passage of the second tubular portion 12. That is, the relationship of $S_1 \geq S_2$ is satisfied. Consequently, the flow rate of the gas-state refrigerant that flows into the second tubular portion 12 is increased, and more compressor oil is allowed to be returned to the compressor 51.

The sectional area $S_2$ of the flow passage of the second tubular portion 12 is smaller than the sectional area of the flow passage of the first tubular portion 11. However, from the point of view of reducing the pressure loss of the refrigerant, it is preferable that the sectional area $S_2$ of the flow passage of the second tubular portion 12 be a size that enables gas refrigerant to pass through the sectional area $S_2$. For example, when a Y-direction width, which is a height between the mutually adjacent flat pipes 3, is 1, a height at which the outflow pipe 5 is connected is set to 3/5 to 9/10 from the lower end of the width of 1. At the same time, the sectional area $S_2$ of the flow passage of the second tubular portion 12 is preferably set to, for example, 1/5 to 1/2 the sectional area of an apparent flow passage of the first tubular portion 11 in a range in which the width between the mutually adjacent flat pipes 3 is narrow.

<Operation of Gas Header 4 with Heat Exchanger 100 as Condenser>

The broken-line arrows illustrated in FIG. 6 indicate flow directions of refrigerant when the heat exchanger 100 is used as a condenser. In the gas header 4, the pressure loss in the pipe is reduced by the second hole 32 provided in the wall 14.

Here, it is preferable that, as illustrated in FIG. 7, the second hole 32 open slightly above the lower end of the wall 14 separating the first tubular portion 11 and the second tubular portion 12 from each other. In particular, it is preferable that at least one flat pipe 3 of the plurality of flat pipes 3 be inserted midway at a location lower than the second hole 32 into the inner portion of the first tubular portion 11. Consequently, it is possible to reduce uneven inflow of gas-state refrigerant to a specific flat pipe 3. It is thus possible to improve performance in distribution of gas-state refrigerant in the gas header 4.

<Effects>

<Effects>

As described above, in the gas header 4, the first tubular portion 11 and the second tubular portion 12 communicate with each other through the second hole 32 provided in the wall 14. Consequently, it is possible to reduce the pressure loss of refrigerant in the gas header 4 and possible to improve heat-exchanging performance. It is also possible to reduce the compressor oil accumulating in the gas header 4 in evaporation operation. Moreover, it is possible to improve performance in distribution of gas-state refrigerant in the gas header 4 in condensation operation. In addition, a reduction in the size of the gas header 4 and an improvement in the strength and the airtightness of the gas header 4 are achieved.

Effects of Embodiment 1

According to Embodiment 1, the gas header 4 is connected to the one end portion of each of the plurality of flat pipes 3 spaced from each other and arranged in the Y direction and connected to the outflow pipe 5, which is a refrigerant pipe through which refrigerant flows out when refrigerant flows in through the plurality of flat pipes 3 and through which refrigerant flows in when refrigerant flows out through the plurality of flat pipes 3. The gas header 4 includes the first tubular portion 11 having a flow passage elongated in the Y direction and through which refrigerant flows in the Y direction and the second tubular portion 12 having a flow passage that has a sectional area smaller than the sectional area of the flow passage of the first tubular portion 11. The first tubular portion 11 and the second tubular portion 12 are integrated with each other. The one end portion of each of the plurality of flat pipes 3 is inserted midway from one direction along the X direction into the inner portion of the first tubular portion 11. The second tubular portion 12 is provided across the first tubular portion 11 from the plurality of flat pipes 3 in the X direction. The second tubular portion 12 is connected at a position midway in the Y direction and upper than the center of the second tubular portion 12 in the Y direction to the outflow pipe 5. The wall 14 between the first tubular portion 11 and the second tubular portion 12 has the first hole 31 opening at the portion connected to the outflow pipe 5 and extending in the X direction and the second hole 32 having a hole diameter smaller than the hole diameter of the first hole 31 and through which the first tubular portion 11 and the second tubular portion 12 communicate with each other at a lower portion.

In this configuration, as the first tubular portion 11 and the second tubular portion 12 communicate with each other through the first hole 31 and the second hole 32 provided in the wall 14, the pressure loss of refrigerant in the gas header 4 is reduced and heat-exchanging performance is increased while a simple structure is achieved. Moreover, opening of the second hole 32 in a lower portion of the gas header 4 reduces compressor oil accumulating in the gas header 4 when the heat exchanger 100 is used as an evaporator. Furthermore, it is possible to improve performance in distribution of gas refrigerant when the heat exchanger 100 is used as a condenser. In addition, a reduction in the size of the gas header 4 and an improvement in the strength and the airtightness of the gas header 4 are achieved.

According to Embodiment 1, the gas header 4 includes the first part 21 forming a portion of the first tubular portion 11 and having the holes 21*a* into which the plurality of flat pipes 3 are inserted and fixed. The gas header 4 includes the second part 22 including the other portion of the first tubular portion 11 and the second tubular portion 12.

In this configuration, the number of components is small, and it is possible to reduce manufacturing costs.

According to Embodiment 1, the first tubular portion 11 and the second tubular portion 12 are equal in length to each other in the Y direction. The Y-direction heights of both end portions in the longitudinal direction of the first tubular portion 11 and the second tubular portion 12 coincide with each other.

In this configuration, a simple structure is achieved.

According to Embodiment 1, the gas header 4 includes the pair of header covers 13 covering the inner portions of both of the first tubular portion 11 and the second tubular portion 12 at both ends in the longitudinal direction of the first tubular portion 11 and the second tubular portion 12.

In this configuration, the inner portions of both of the first tubular portion 11 and the second tubular portion 12 are covered by the pair of header covers 13, and the number of components and manufacturing costs are allowed to be reduced while a simple structure is achieved.

According to Embodiment 1, the pair of header covers 13 each include the large-diameter portion 13*a* abutting on the end surfaces of both of the first tubular portion 11 and the second tubular portion 12. The pair of header covers 13 each include the first cap portion 13*b* projecting from the large-diameter portion 13*a* into the inner portion of the first tubular portion 11 to cap the inner portion of the first tubular portion 11. The pair of header covers 13 each include the second cap portion 13*c* projecting from the large-diameter portion 13*a* into the inner portion of the second tubular portion 12 to cap the inner portion of the second tubular portion 12.

In this configuration, the pair of header covers 13 cap the inner portion of the first tubular portion 11 by the first cap portions 13*b* and cap the inner portion of the second tubular portion 12 by the second cap portions 13*c* simultaneously, the number of manufacturing steps is allowed to be reduced, and manufacturing costs is allowed to be reduced.

According to Embodiment 1, the sectional shape of the flow passage in the inner portion of each of the first tubular portion 11 and the second tubular portion 12 is circular.

In this configuration, refrigerant flows smoothly in both of the first tubular portion 11 and the second tubular portion 12, and the pressure loss of the refrigerant is allowed to be reduced.

According to Embodiment 1, the sectional area $S_1$ of the opening of the second hole 32 is more than or equal to the sectional area $S_2$ of the flow passage of the second tubular portion 12.

In this configuration, refrigerant flows smoothly through the second hole 32, and the pressure loss of the refrigerant is allowed to be reduced.

According to Embodiment 1, at a position lower than the second hole 32, an end portion of at least one flat pipe 3 of the plurality of flat pipes 3 inserted into the first tubular portion 11 is positioned.

In this configuration, refrigerant flowing from the flat pipe 3 positioned lower than the second hole 32 flows into the compressor oil that nearly accumulates at the bottom portion of the first tubular portion 11, and oil-returning performance is improved.

According to Embodiment 1, the heat exchanger 100 includes the gas header 4. The heat exchanger 100 includes the plurality of flat pipes 3 spaced from each other and arranged in the Y direction. The heat exchanger 100 includes the refrigerant distributor 2, which is a liquid header connected to the other ends of the plurality of flat pipes 3.

In this configuration, the pressure loss of refrigerant in the gas header 4 is allowed to be reduced while a simple structure is achieved in the heat exchanger 100 including the aforementioned gas header 4.

Embodiment 2

<Gas Header 4>

Figure 8:
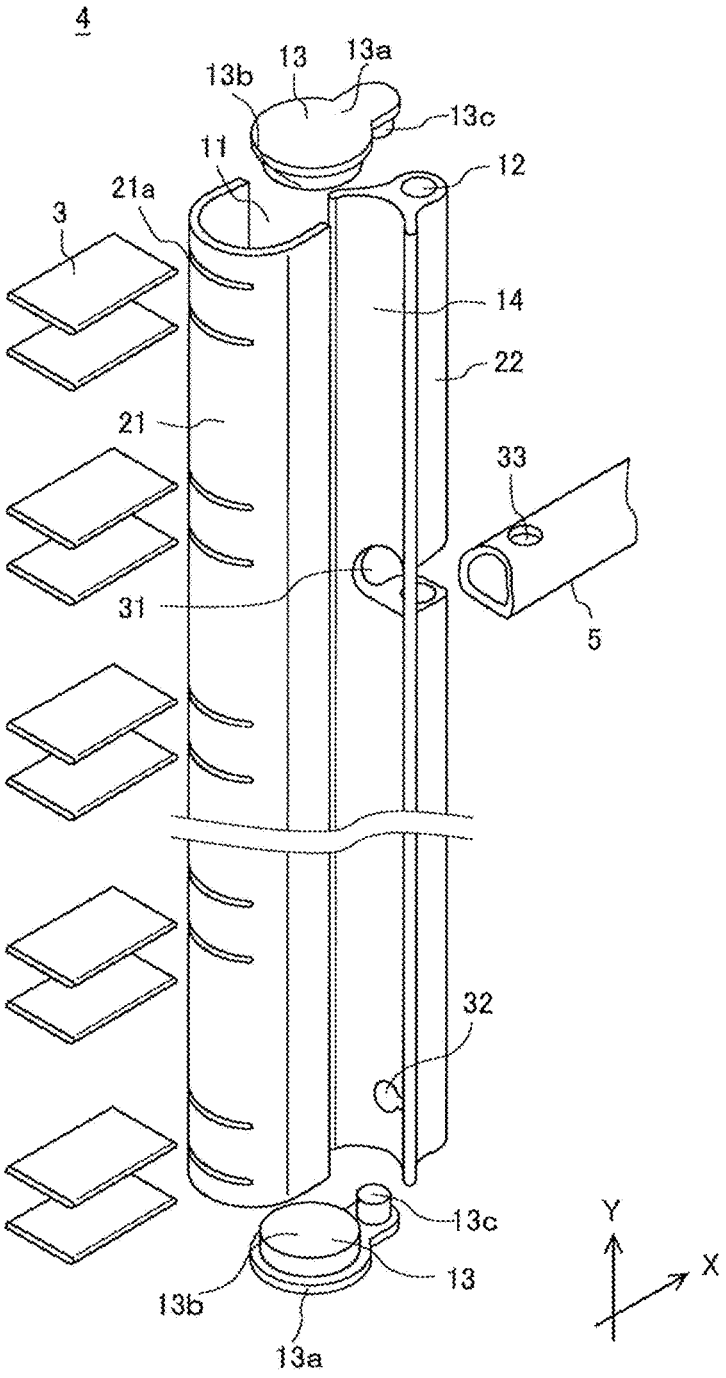
FIG. 8 is an exploded perspective view of a gas header according to Embodiment 2 of the present disclosure.
Figure 9:
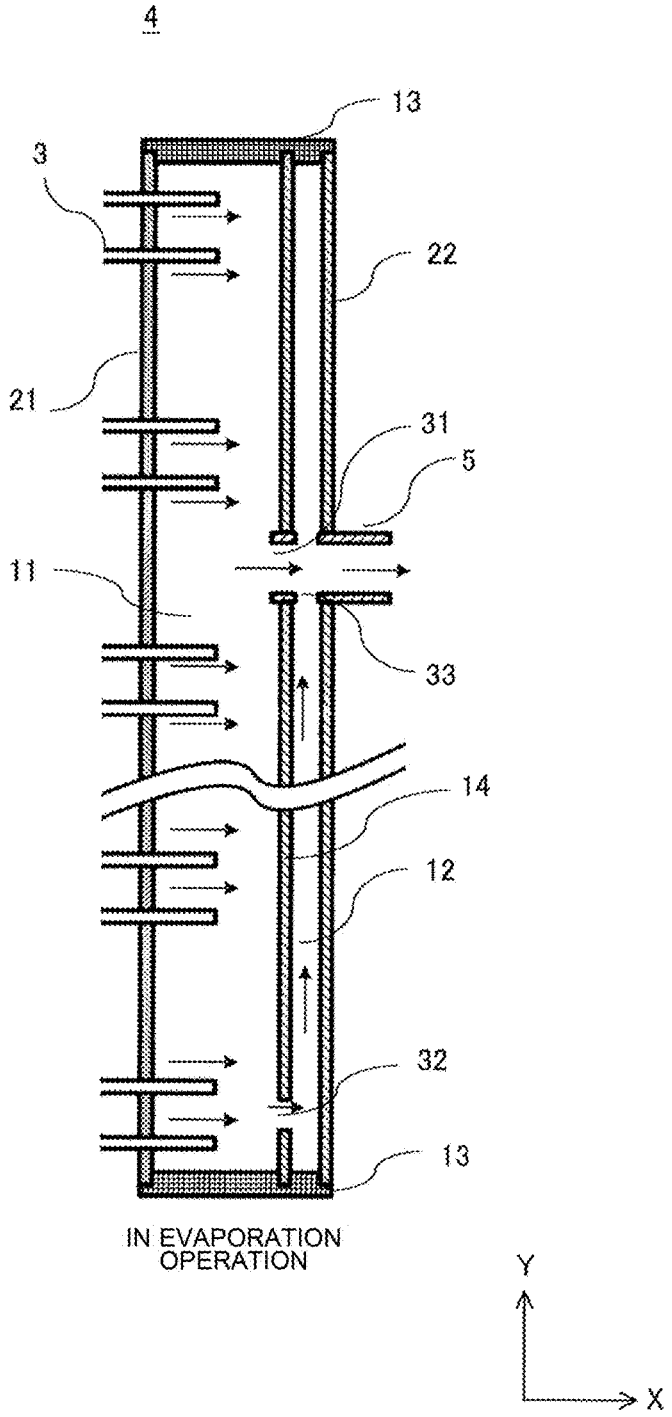
FIG. 9 is an explanatory view in which the gas header when a heat exchanger according to Embodiment 2 of the present disclosure is used as an evaporator is illustrated in a vertical section.
Figure 10:
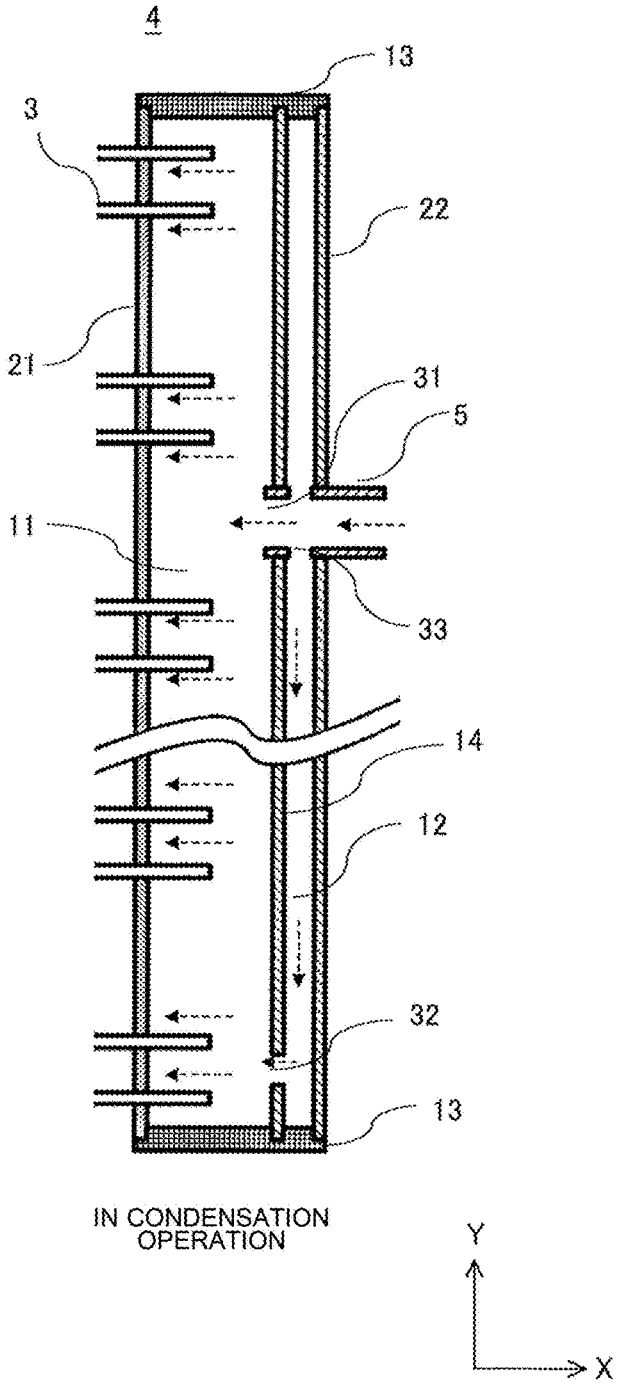
FIG. 10 is an explanatory view in which the gas header when the heat exchanger according to Embodiment 2 of the present disclosure is used as a condenser is illustrated in a vertical section.

FIG. 8 is an exploded perspective view of the gas header 4 according to Embodiment 2 of the present disclosure. FIG. 9 is an explanatory view in which the gas header 4 when the heat exchanger 100 according to Embodiment 2 of the present disclosure is used as an evaporator is illustrated in a vertical section. FIG. 10 is an explanatory view in which the gas header 4 when the heat exchanger 100 according to Embodiment 2 of the present disclosure is used as a condenser is illustrated in a vertical section. Regarding Embodiment 2, description of the same matters as those in the aforementioned Embodiment 1 is omitted, and features of Embodiment 2 will be described.

As illustrated in FIG. 8, FIG. 9, and FIG. 10, spaces in the Y direction between the end portions of the plurality of flat pipes 3 inserted midway into the first tubular portion 11 are arranged such that narrow spaces of the spaces and wide spaces of the spaces are mixedly present. The position of the first hole 31 is a position at the center in the Y direction of one of the wide spaces in the Y direction between end portions of the flat pipes 3 that are mutually adjacent to each other, of the plurality of flat pipes 3. In this configuration, a flow passage reduced portion of the first tubular portion 11 of which flow passage is reduced by the insertion of the flat pipe 3 and a flow passage reduced portion of the first tubular portion 11 of which flow passage is reduced by the insertion of the outflow pipe 5 are not close to each other. Consequently, the flow passage reduced portion of the first tubular portion 11 is not excessively reduced, and the pressure loss of refrigerant in the first tubular portion 11 is allowed to be reduced, which is further preferable. Moreover, in distribution of gas refrigerant in condensation operation, uneven inflow of gas-state refrigerant to a specific flat pipe 3 in the gas header 4 is reduced, and performance in distribution of the gas-state refrigerant is improved, which is further preferable.

Preferably, the position of the second hole 32 is a position in a range in the Y direction of one of the narrow spaces in the Y direction between end portions of ones of the plurality of flat pipes 3 that are mutually adjacent to each other. In particular, when the position of the second hole 32 is set at the narrow space in the Y direction between the end portions of mutually adjacent flat pipes 3 at the lowermost portion, gas-state refrigerant strongly flows from the flat pipes 3 into the first hole 31. It is thus possible to increase the effect of returning the compressor oil that has accumulated at the lower portion of the first tubular portion 11 to the compressor 51 through the second hole 32 via the second tubular portion 12.

Effects of Embodiment 2

According to Embodiment 2, the spaces in the Y direction between the end portions of the plurality of flat pipes 3 inserted into the first tubular portion 11 are arranged such that the narrow spaces of the spaces and the wide spaces of the spaces are mixedly present.

In this configuration, expansion and reduction in the sectional area of the flow passage in the refrigerant-flow direction are gentle at the narrow spaces in the Y direction between the end portions of the plurality of flat pipes 3, and the pressure loss of the refrigerant in the first tubular portion 11 is allowed to be reduced.

According to Embodiment 2, the position of the first hole 31 is a position at the center in the Y direction of the one of the wide spaces in the Y direction between the end portions of the flat pipes 3 that are mutually adjacent to each other.

In this configuration, uneven inflow of gas-state refrigerant to a specific flat pipe 3 is reduced in the distribution of the gas-state refrigerant when the heat exchanger 100 is used as a condenser, and performance in the distribution of the gas-state refrigerant is improved.

According to Embodiment 2, the position of the second hole 32 is a position in a range in the Y direction of a narrow space in the Y direction between the end portions of the mutually adjacent flat pipes 3.

In this configuration, gas-state refrigerant easily flows strongly into the second hole 32 from the flat pipes 3 of which end portions in the Y direction mutually adjacent to each other have a narrow space between the end portions. Therefore, the compressor oil that nearly accumulates at the bottom portion of the first tubular portion 11 easily flows together with the gas-state refrigerant into the second tubular portion 12, and oil-returning performance is improved.

Embodiment 3

<Air-Conditioning Apparatus 50>

Figure 11:
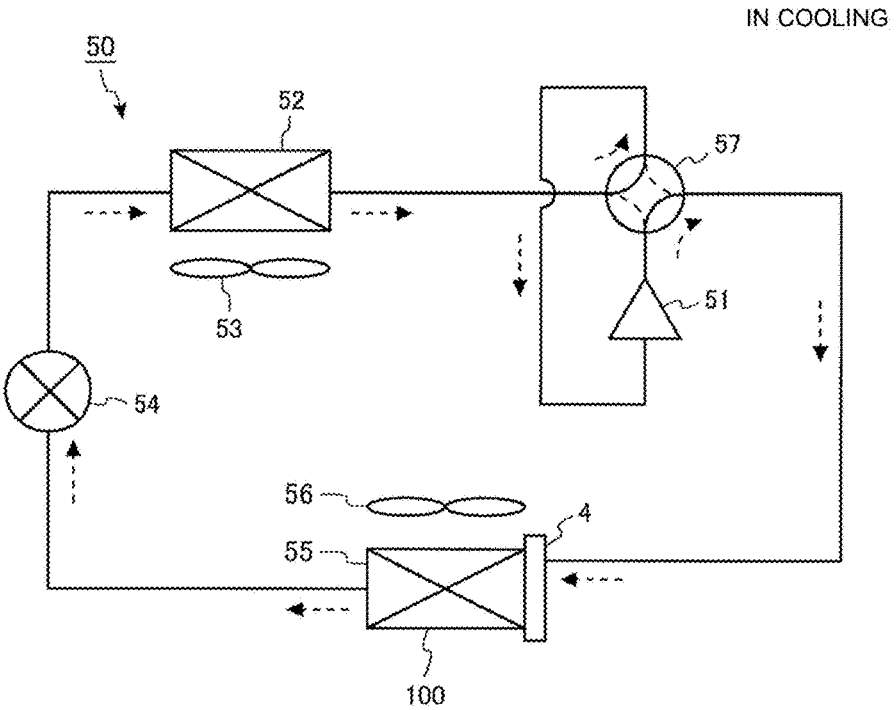
FIG. 11 is a refrigerant circuit diagram illustrating an air-conditioning apparatus according to Embodiment 3 of the present disclosure in cooling operation.
Figure 12:
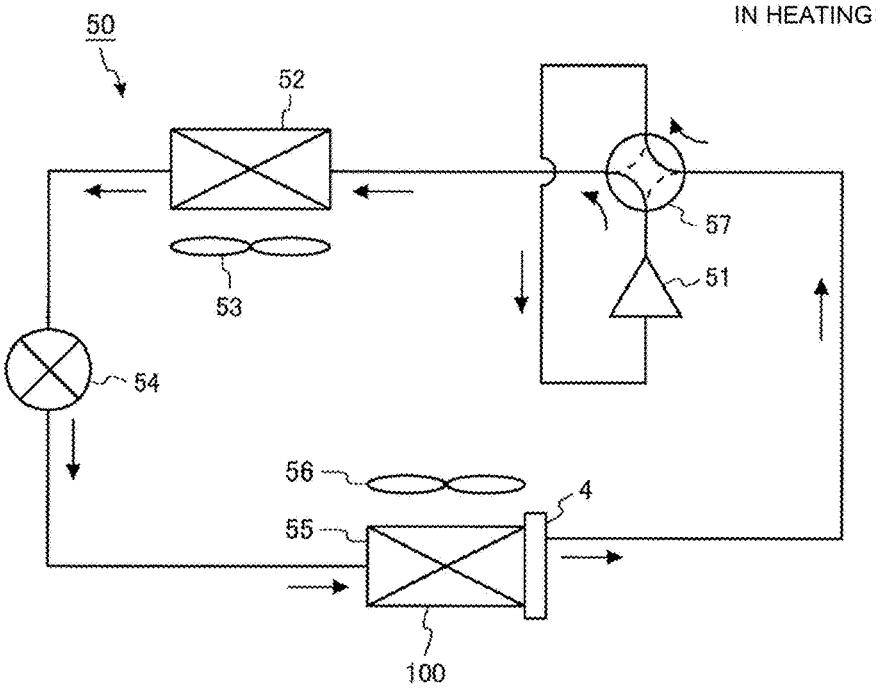
FIG. 12 is a refrigerant circuit diagram illustrating the air-conditioning apparatus according to Embodiment 3 of the present disclosure in heating operation.

FIG. 11 is a refrigerant circuit diagram illustrating an air-conditioning apparatus 50 according to Embodiment 3 of the present disclosure in cooling operation. FIG. 12 is a refrigerant circuit diagram illustrating the air-conditioning apparatus 50 according to Embodiment 3 of the present disclosure in heating operation. The air-conditioning apparatus 50 is an example of a refrigeration cycle apparatus.

As illustrated in FIG. 11 and FIG. 12, the air-conditioning apparatus 50 includes the compressor 51, an indoor heat exchanger 52, an indoor fan 53, an expansion valve 54, an outdoor heat exchanger 55, an outdoor fan 56, and a flow passage switching device 57.

As the compressor 51, for example, a rotary compressor, a scroll compressor, a screw compressor, a reciprocating compressor, or the other compressors may be used.

As the indoor heat exchanger 52, for example, a fin-and-tube heat exchanger, a microchannel heat exchanger, a shell-and-tube heat exchanger, a heat-pipe heat exchanger, a double tube heat exchanger, a plate heat exchanger, or the other heat exchangers may be used.

As the expansion valve 54, for example, an electric expansion valve capable of controlling the flow rate of refrigerant or the other expansion valves may be used. The expansion valve 54 is not limited to only an electric expansion valve and may be a mechanical expansion valve in which a diaphragm is employed in a pressure receiving portion, or the other expansion valves.

The flow passage switching device 57 is, for example, a four-way valve or the other valves. The flow passage switching device 57 switches the destination of refrigerant from a discharge port of the compressor 51 to the indoor heat exchanger 52 or the outdoor heat exchanger 55.

In the air-conditioning apparatus 50, the heat exchanger 100 described in Embodiment 1 and Embodiment 2 is used as the outdoor heat exchanger 55. An improvement in energy efficiency is achieved by using the heat exchanger 100.

In the refrigeration cycle apparatus, such as the air-conditioning apparatus 50, the heat exchanger 100 may be employed as one or both of the outdoor heat exchanger 55 and the indoor heat exchanger 52.

<Operation of Air-conditioning Apparatus 50>

<Cooling Operation>

The broken-line arrows illustrated in FIG. 11 indicate the flow of refrigerant in cooling operation. The compressor 51 is operated to discharge gas-state refrigerant having a high temperature and a high pressure from the compressor 51. The gas-state refrigerant having a high temperature and a high pressure discharged from the compressor 51 flows via the flow passage switching device 57 into the outdoor heat exchanger 55 used as a condenser. In the outdoor heat exchanger 55, heat is exchanged between the gas-state refrigerant having a high temperature and a high pressure that has flowed in and outdoor air supplied by the outdoor fan 56. Through the heat exchange, the gas-state refrigerant having a high temperature and a high pressure is condensed and becomes liquid-state refrigerant having a high pressure.

Here, a detailed operation state in the outdoor heat exchanger 55 as which the heat exchanger 100 is used will be described below. The gas-state refrigerant having a high temperature and a high pressure discharged from the compressor 51 flows from the outflow pipe 5 into the outdoor heat exchanger 55. Portion of the gas-state refrigerant having a high temperature and a high pressure that has flowed into the outflow pipe 5 flows into the first tubular portion 11 directly. The other portion of the gas-state refrigerant having a high temperature and a high pressure that has flowed into the outflow pipe 5 passes through the second tubular portion 12 and flows into a lower portion of the first tubular portion 11 via the second hole 32. Then, the gas-state refrigerant having a high temperature and a high pressure that has flowed into the first tubular portion 11 branches and flows into the plurality of flat pipes 3. When flowing in each of the plurality of flat pipes 3, the gas-state refrigerant having a high temperature and a high pressure exchanges heat through the surfaces of the flat pipes 3 and the surfaces of the fins 6 with outdoor air supplied by the outdoor fan 56. Consequently, the gas-state refrigerant having a high temperature and a high pressure flowing in each of the flat pipes 3 is condensed and becomes liquid-state refrigerant having a high pressure, and flows out from the outdoor heat exchanger 55 via the refrigerant distributor 2.

Subsequently, the liquid-state refrigerant having a high pressure that has flowed out from the outdoor heat exchanger 55 is caused to be gas-liquid two-phase state refrigerant having a low pressure by the expansion valve 54. The gas-liquid two-phase state refrigerant flows into the indoor heat exchanger 52 used as an evaporator. In the indoor heat exchanger 52, heat is exchanged between the gas-liquid two-phase state refrigerant that has flowed in and indoor air supplied by the indoor fan 53. Through the heat exchange, liquid-state refrigerant in the gas-liquid two-phase state refrigerant evaporates and becomes gas-state refrigerant having a low pressure. Because of an effect of the heat exchange, the indoor air of which heat has been exchanged is cooled, and the inside of a room is cooled. The gas-state refrigerant having a low pressure that has been sent out from the indoor heat exchanger 52 flows into the compressor 51 via the flow passage switching device 57. The gas refrigerant having a low pressure is compressed in the compressor 51, becomes gas-state refrigerant having a high temperature and a high pressure, and is discharged again from the compressor 51. Then, this cycle is repeated.

<Heating Operation>

The solid-line arrows illustrated in FIG. 12 indicate the flow of refrigerant in heating operation. The compressor 51 is operated to discharge gas-state refrigerant having a high temperature and a high pressure from the compressor 51. The gas-state refrigerant having a high temperature and a high pressure that has been discharged from the compressor 51 flows via the flow passage switching device 57 into the indoor heat exchanger 52 used as a condenser. In the indoor heat exchanger 52, heat is exchanged between the gas-state refrigerant having a high temperature and a high pressure that has flowed in and indoor air supplied by the indoor fan 53. Through the heat exchange, the gas-state refrigerant having a high temperature and a high pressure is condensed and becomes liquid-state refrigerant having a high pressure. Because of an effect of the heat exchange, indoor air is heated, and the inside of a room is heated.

The liquid-state refrigerant having a high pressure that has been sent out from the indoor heat exchanger 52 is caused to be gas-liquid two-phase state refrigerant having a low pressure by the expansion valve 54. The gas-liquid two-phase state refrigerant flows into the outdoor heat exchanger 55 used as an evaporator. In the outdoor heat exchanger 55, heat is exchanged between the gas-liquid two-phase state refrigerant that has flowed in and outdoor air supplied by the outdoor fan 56. Through the heat exchange, liquid-state refrigerant in the gas-liquid two-phase state refrigerant evaporates and becomes gas-state refrigerant having a low pressure.

Here, a detailed operation state in the outdoor heat exchanger 55 as which the heat exchanger 100 is used will be described below. The refrigerant that has been caused to enter the gas-liquid two-phase state by the expansion valve 54 flows into each of the plurality of flat pipes 3 in the outdoor heat exchanger 55. When flowing in each of the plurality of flat pipes 3, the gas-liquid two-phase state refrigerant exchanges heat through the surfaces of the flat pipes 3 and the surfaces of the fins 6 with outdoor air supplied by the outdoor fan 56. Through the heat exchange, the gas-liquid two-phase state refrigerant flowing in each of the plurality of flat pipes 3 becomes gas-state refrigerant having a low pressure. The gas-state refrigerant having a low pressure flows out to the gas header 4 from end portions of the flat pipes 3 and is merged together in the first tubular portion 11.

Portion of the gas-state refrigerant that has been merged together in the first tubular portion 11 of the gas header 4 flows into the outflow pipe 5 directly. The other portion of the gas-state refrigerant that has been merged together in the first tubular portion 11 passes through the second tubular portion 12 via the second hole 32 and flows into the outflow pipe 5. The gas-state refrigerant that has flowed into the outflow pipe 5 flows out from the outdoor heat exchanger 55.

Subsequently, the gas-state refrigerant having a low pressure that has flowed out from the outdoor heat exchanger 55 flows into the compressor 51 via the flow passage switching device 57. The gas-state refrigerant having a low pressure that has flowed into the compressor 51 is compressed and becomes gas-state refrigerant having a high temperature and a high pressure and is discharged again from the compressor 51. Then, this cycle is repeated.

<Defrosting Operation>

In heating operation where the temperature of outdoor air is low, moisture in air is condensed and adheres to the outdoor heat exchanger 55, which is used as an evaporator and may freeze on a surface of the outdoor heat exchanger 55. That is, there is a likelihood of frost formation occurring on the outdoor heat exchanger 55. Therefore, the air-conditioning apparatus 50 performs "defrosting operation" that removes frost adhering to the outdoor heat exchanger 55 in heating operation.

The "defrosting operation" is operation in which gas-state refrigerant having a high temperature and a high pressure is supplied from the compressor 51 to the outdoor heat exchanger 55 to melt and remove the frost adhering to the outdoor heat exchanger 55, which is used as an evaporator. To start defrosting operation, the flow passage of the flow passage switching device 57 is switched to a flow passage for cooling operation in the air-conditioning apparatus 50. That is, the outflow pipe 5 of the outdoor heat exchanger 55 communicates with the discharge port of the compressor 51 in defrosting operation.

Effects of Embodiment 3

According to Embodiment 3, the air-conditioning apparatus 50 as a refrigeration cycle apparatus includes the heat exchanger 100.

In this configuration, the refrigeration cycle apparatus including the aforementioned heat exchanger 100 reduces the pressure loss of refrigerant in the gas header 4 while achieving a simple structure.

Embodiments 1 to 3 of the present disclosure may be combined together or may be applied to the other parts.

REFERENCE SIGNS LIST

1: inflow pipe, 2: refrigerant distributor, 3: flat pipe, 4: gas header, 5: outflow pipe, 6: fin, 11: first tubular portion, 12: second tubular portion, 13: header cover, 13*a*: large-diameter portion, 13*b*: first cap portion, 13*c*: second cap portion, 14: wall, 21: first part, 21*a*: hole, 22: second part, 31: first hole, 32: second hole, 33: hole, 50: air-conditioning apparatus, 51: compressor, 52: indoor heat exchanger, 53: indoor fan, 54: expansion valve, 55: outdoor heat exchanger, 56: outdoor fan, 57: flow passage switching device, 100: heat exchanger

The invention claimed is:

1. A gas header connected to a plurality of flat pipes at one end portion of each of the plurality of flat pipes, the plurality of flat pipes being spaced from each other and arranged in an up-down direction, the gas header being connected to a refrigerant pipe, refrigerant flowing out through the refrigerant pipe when refrigerant flows in through the plurality of flat pipes, refrigerant flowing out through the plurality of flat pipes when refrigerant flows in through the refrigerant pipe, the gas header comprising:

a first tubular portion including a flow passage for refrigerant extending in the up-down direction; and a second tubular portion including a flow passage having a sectional area smaller than a sectional area of the flow passage of the first tubular portion, the first tubular portion and the second tubular portion being integrated with each other, the one end portion of each of the plurality of flat pipes being inserted midway from one direction along a horizontal direction into an inner portion of the first tubular portion, the second tubular portion being provided across the first tubular portion from the plurality of flat pipes in the horizontal direction, the second tubular portion being connected at a position midway in the up-down direction and upper than a center of the second tubular portion in the up-down direction to the refrigerant pipe, a wall between the first tubular portion and the second tubular portion having a first hole opening and extending in the horizontal direction at a portion connected to the refrigerant pipe and a second hole through which the first tubular portion and the second tubular portion communicate with each other at a portion lower than the first hole and having a hole diameter smaller than a hole diameter of the first hole, an end portion of at least one flat pipe of the plurality of flat pipes inserted into the first tubular portion being positioned at a position lower than the second hole.

2. The gas header of claim 1, comprising:

a first part forming a portion of the first tubular portion and having holes in which the plurality of flat pipes are inserted and fixed; and a second part including an other portion of the first tubular portion and the second tubular portion.

3. The gas header of claim 1, wherein the first tubular portion and the second tubular portion are equal in length to each other in the up-down direction, and wherein horizontal-direction heights of both end portions in a longitudinal direction of the first tubular portion and the second tubular portion coincide with each other.

4. The gas header of claim 1, comprising a pair of header covers covering, at each of both ends in a longitudinal direction of the first tubular portion and the second tubular portion, the inner portion of the first tubular portion and an inner portion of the second tubular portion.

5. The gas header of claim 4, wherein the pair of header covers each include a large-diameter portion abutting on corresponding end surfaces of both of the first tubular portion and the second tubular portion, a first cap portion projecting from the large-diameter portion into the inner portion of the first tubular portion and capping the inner portion of the first tubular portion, and a second cap portion projecting from the large-diameter portion into the inner portion of the second tubular portion and capping the inner portion of the second tubular portion.

6. The gas header of claim 1, wherein a sectional shape of the flow passage in an inner portion of each of the first tubular portion and the second tubular portion is circular.

7. The gas header of claim 1, wherein a sectional area of an opening of the second hole is more than or equal to the sectional area of the flow passage of the second tubular portion.

8. The gas header of claim 1, wherein spaces in the up-down direction between the end portions of the plurality of flat pipes inserted into the first tubular portion are arranged such that at least one narrow space of the spaces and at least one wide space of the spaces are mixedly present.

9. A heat exchanger comprising the gas header of claim 1.

10. A refrigeration cycle apparatus comprising the heat exchanger of claim 9.

11. A gas header connected to a plurality of flat pipes at one end portion of each of the plurality of flat pipes, the plurality of flat pipes being spaced from each other and arranged in an up-down direction, the gas header being connected to a refrigerant pipe, refrigerant flowing out through the refrigerant pipe when refrigerant flows in through the plurality of flat pipes, refrigerant flowing out through the plurality of flat pipes when refrigerant flows in through the refrigerant pipe, the gas header comprising:

a first tubular portion including a flow passage for refrigerant extending in the up-down direction; and a second tubular portion including a flow passage having a sectional area smaller than a sectional area of the flow passage of the first tubular portion, the first tubular portion and the second tubular portion being integrated with each other, the one end portion of each of the plurality of flat pipes being inserted midway from one direction along a horizontal direction into an inner portion of the first tubular portion, the second tubular portion being provided across the first tubular portion from the plurality of flat pipes in the horizontal direction, the second tubular portion being connected at a position midway in the up-down direction and upper than a center of the second tubular portion in the up-down direction to the refrigerant pipe, a wall between the first tubular portion and the second tubular portion having a first hole opening and extending in the horizontal direction at a portion connected to the refrigerant pipe and a second hole through which the first tubular portion and the second tubular portion communicate with each other at a portion lower than the first hole and having a hole diameter smaller than a hole diameter of the first hole, spaces in the up-down direction between end portions of ones mutually adjacent to each other of the plurality of flat pipes inserted into the first tubular portion including at least one narrow space and at least one wide space, a position of the first hole being a position at a center in the up-down direction of one of the at least one wide space in the up-down direction between end portions of ones of the plurality of flat pipes that are mutually adjacent to each other.

12. The gas header of claim 11, wherein a position of the second hole is a position in a range in the up-down direction of one of the at least one narrow space in the up-down direction between end portions of ones of the plurality of flat pipes that are mutually adjacent to each other.

* * * * *